US006781558B2

(12) United States Patent
Steinkamp

(10) Patent No.: US 6,781,558 B2
(45) Date of Patent: Aug. 24, 2004

(54) ANTENNA MAST AND METHOD

(75) Inventor: Jeffrey H. Steinkamp, Quincy, IL (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/188,032

(22) Filed: Jul. 3, 2002

(65) Prior Publication Data

US 2004/0004578 A1 Jan. 8, 2004

(51) Int. Cl.[7] ..... H01Q 9/34
(52) U.S. Cl. ..... 343/874; 343/890; 343/891
(58) Field of Search ..... 343/874, 890, 343/891

(56) References Cited

U.S. PATENT DOCUMENTS 4,145,696 A * 3/1979 Gueguen ..... 343/792.5
5,787,673 A * 8/1998 Noble ..... 52/726.1
5,855,103 A * 1/1999 Moore ..... 52/651.02
5,999,145 A * 12/1999 Niekamp ..... 343/890
6,028,566 A * 2/2000 Pennell et al. ..... 343/878
6,088,002 A * 7/2000 Johnson et al. ..... 343/878
6,115,004 A * 9/2000 McGinnis ..... 343/890
6,133,890 A * 10/2000 Damiani ..... 343/890
6,275,197 B1 * 8/2001 Behr ..... 343/890
6,557,312 B2 * 5/2003 McGinnis ..... 52/296
6,563,475 B2 * 5/2003 Ianello et al. ..... 343/890

* cited by examiner

*Primary Examiner*—Tan Ho
(74) *Attorney, Agent, or Firm*—Baker & Hostetler LLP

(57) ABSTRACT

An antenna mast is disclosed that has N faces, N corners that are intermediate adjacent faces, and N fins that each include a plurality of bars that extend between a first side and a second side of each fin in a direction opposite to an adjacent one of the plurality of bars. The antenna mast disclosed is lightweight, easy to maneuver and utilizes minimal raw material, while maintaining its structural integrity.

20 Claims, 3 Drawing Sheets

ANTENNA MAST AND METHOD

FIELD OF THE INVENTION

The present invention relates generally to an antenna mast. More particularly, the present invention is directed to a light weight antenna mast.

BACKGROUND OF THE INVENTION

Under the rules of the Federal Communication Commission (FCC), television (TV) broadcasters are required to complete a transition from their current National Television System Committee antenna systems to digital television (DTV) antenna systems by the year 2006. To fulfill the requirements of the FCC, TV broadcasters are installing DTV antenna systems on their existing antenna towers.

The addition of the DTV antennas to the existing antenna towers has not only reduced the amount of space available for leasing out, but has also driven up both the weight loads and windloads of those existing antenna towers. The number of antennas that can be installed on an antenna tower is limited to the amount of tower space, the amount of weight the tower can withstand and/or the amount of windload the tower can withstand. Accordingly, a tower can only withstand a certain amount of weight and/or windload before the tower fails in its support functions.

Constucting new towers is usually not a feasible solution. Aside from the high cost of tower construction, difficulties arise in finding an acceptable location and in obtaining construction permits. Often, community members near the proposed construction site oppose the building of antenna towers in their communities. In addition, tower construction is limited to locations where the environmental conditions are suitable for the erection of an antenna tower. For example, it is not suitable to bulid antenna towers where the moisture level in the soil is high.

To alleviate overcrowding and potentially overloading antenna towers, television station operators have turned to sharing multi-channel antennas. Multi-channel antennas are capable of transmitting more than one station, and thus, it is possible to avoid having an antenna for every station.

As a result, TV station operators desire to utilize multi-channel antennas that are capable of being stacked vertically to increase the signal transmitting capability of the antenna tower structure. Thus, each antenna mast structure must be capable of supporting one or more antennas that may be vertically stacked on top of it.

Accordingly, it would be desirable to provide a mast structure for an antenna that can support a number of antennas stacked vertically on top of it.

SUMMARY OF THE INVENTION

In one aspect of the present invention an antenna mast is provided that includes, N faces, N corners intermediate adjacent ones of the N faces, and N fins. Each of the N fins extends radially from each of the N corners and includes a plurality of bars.

In another aspect of the present invention, an inner support structure is provided, and each of the N fins extends radially from the inner support structure.

In another aspect of the present invention, each of the N fins extends between the inner support structure and one of the N corners.

In another aspect of the present invention, each of the plurality of bars extends diagonally across each of the N fins in a direction oppsoite to an adjacent one of the plurality of bars.

In another aspect of the present invention, each of the plurality of bars extends diagonally across each of the N fins in a direction opposite to an adjacent one of the plurality of bars.

In another aspect of the present invention, each of the N fins comprises M sections, and at least two of the plurality of bars are spaced apart in each of the M sections.

In another aspect of the present invention, at least two of the plurality of bars extend diagonally across each of the M sections in opposite directions.

In another aspect of the present invention, the inner support structure is hollow and each of the N fins are welded to the inner support structure.

In another aspect of the present invention, the inner support structure is cylindrical in shape, has a diameter of approximately six inches, and a wall thickness of approximately four tenths of an inch.

In another aspect of the present invention, N is a five.

In another aspect of the present invention, each of the N faces has a radially extending flange.

In another aspect of the present invention, each radially extending flange is coupled to an adjacent flange.

In another aspect of the present invention, an antenna mast is provided that includes, a means for coupling N faces of a mast together, a means for sectioning the mast, wherein the sectioning means has a first side and a second side and is positioned intermediate adjacent ones of the N faces, and a means for coupling a plurality of bars between a first side and a second side of the sectioning means.

In yet another aspect of the present invention, a method of manufacturing a mast is provided that includes, coupling N faces of a mast together, positioning a fin, having a first side and a second side, intermediate adjacent ones of the N faces, and forming the fin by extending a plurality of bars between the first side and the second side of the fin.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

DETAILED DESCRIPTION OF PREFERRED EMBODIMENTS OF THE INVENTION

Figure 1:
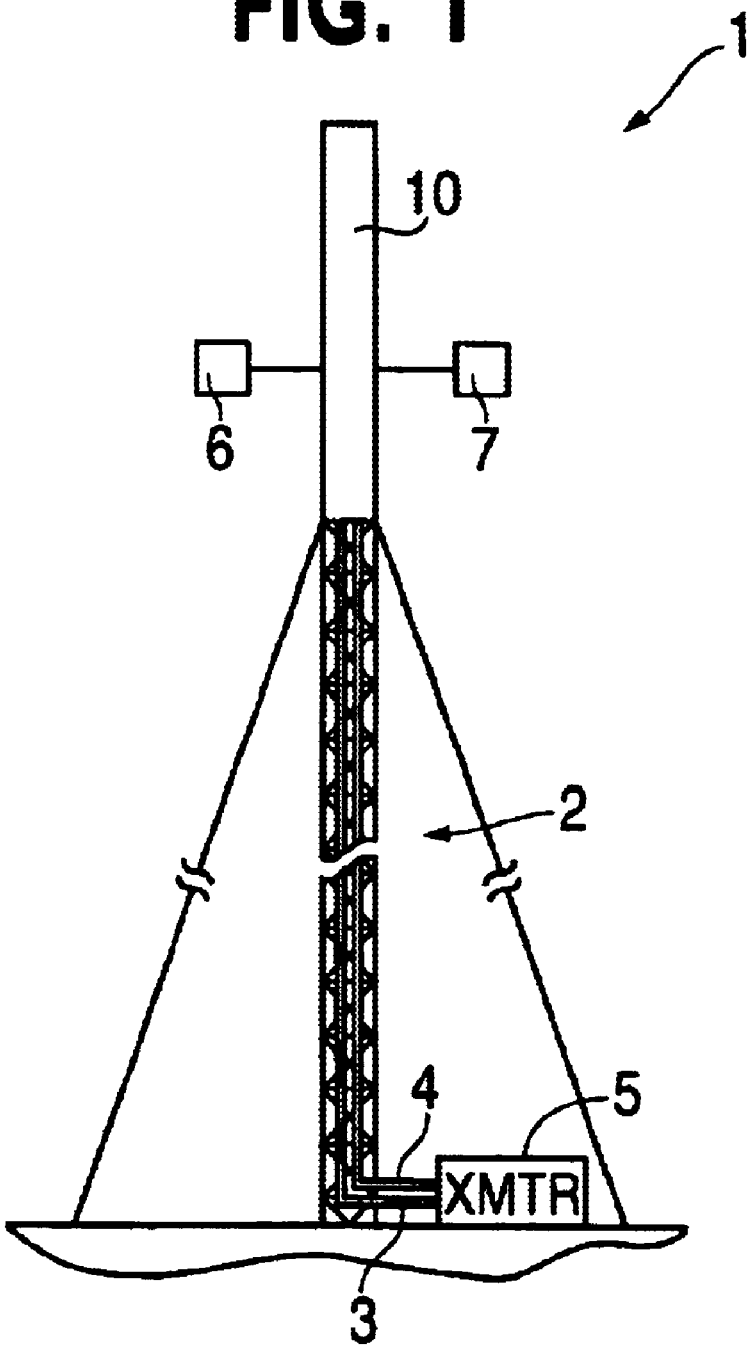
FIG. 1 illustrates an antenna system in accordance with the present invention.

Referring now to the figures, wherein like reference numerals indicate like elements, there is shown, in FIG. 1 of the figures, an antenna system 1 that includes a tower 2, feed lines 3, 4 and a transmitter 5. The feed lines 3,4 are utilized to send a signal from the transmitter 5 to antenna assemblies 6, 7 that are positioned around a mast 10 in accordance with the present invention.

Figure 2:
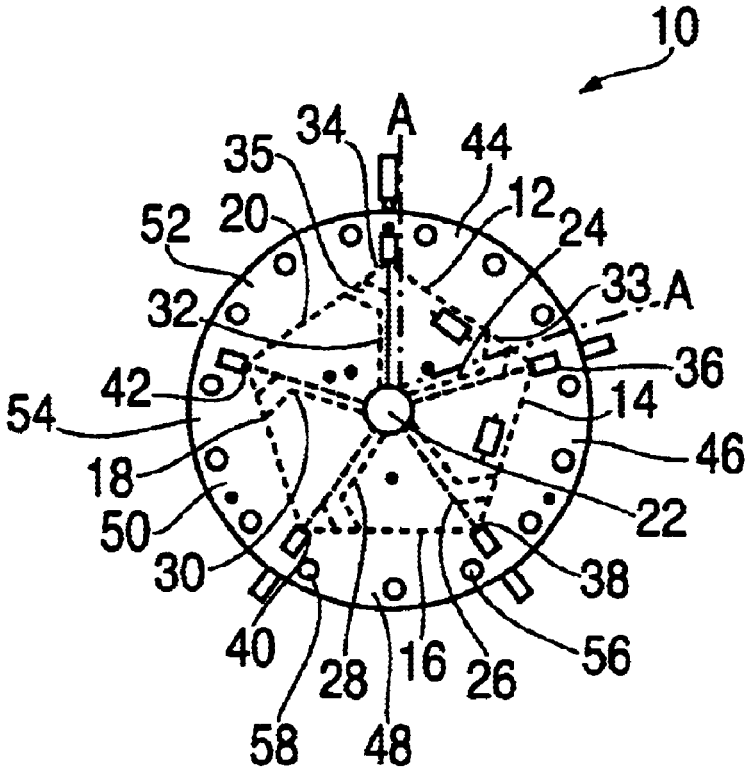
FIG. 2 illustrates a top view of a mast in accordance with the present invention.

The mast 10, as illustrated in the top view of FIG. 2, has five faces 12–20 and is pentagonal in cross-section. Positioned within the mast 10 is an inner support structure 22 that may be utilized to house antenna feed lines. In an exemplary embodiment of the present invention, the inner support structure 22 is cylindrical in shape and has an outside diameter of approximately six inches, and a wall thickness of approximately four tenths of an inch. Also, in an exemplary embodiment of the present invention, the inner support structure 22 has an outside diameter of 6.625 inches and a wall thickness of 0.432 inches. In the same or another exemplary embodiment of the present invention, a flange portion is coupled to or formed continuously with the bottom of the inner support structure 22.

Fins 24–32 are coupled to the faces 12–20 of the mast 10. In an exemplary embodiment of the present invention, the fins 24–32 radially extend from the inner support structure 22 to the faces 12–20 of the mast 10. In the same or another exemplary embodiment of the present invention, each fin 24–32 is positioned between adjacent faces 12–20 of the mast 10. Corners 34–42 are established where adjacent faces 12–20 meet.

In an exemplary embodiment of the present invention, each fin 24–32 is welded to the inner support structure 22. In the same or another exemplary embodiment of the present invention, each fin 24–32 is secured to the faces 12–20 via a seam that extends vertically downward from each corner 34–42. In an exemplary embodiment of the present invention, each fin 24–32 is welded to the seam between adjacent faces 12–20. In the same or another exemplary embodiment of the present invention, support members 33, 35 are positioned along side each fin 24–32.

In an exemplary embodiment of the present invention each face 12–20 has a flange 44–52. In the same or another exemplary embodiment of the present invention, each flange 44–52 extends radially from a face 12–20. The flanges 44–52, when coupled together, form a base 54 of the mast. In another exemplary embodiment of the present invention, each of the faces 12–20 is individually coupled to the base 54, for example via welding. Ports 56, 58 are provided on the base 54, so that the mast of another antenna can be coupled to the mast 10 by, for example, bolts.

It should be understood by one of ordinary skill in the art that the mast 10 may have any number N of faces 12–20. In an exemplary embodiment of the present invention, each mast has N corners, N faces, and N fins. However, it should be understood by one of ordinary skill in the art that the number of corners 34–42, faces 12–20 and fins 24–32 may not be equivalent.

Figure 3:
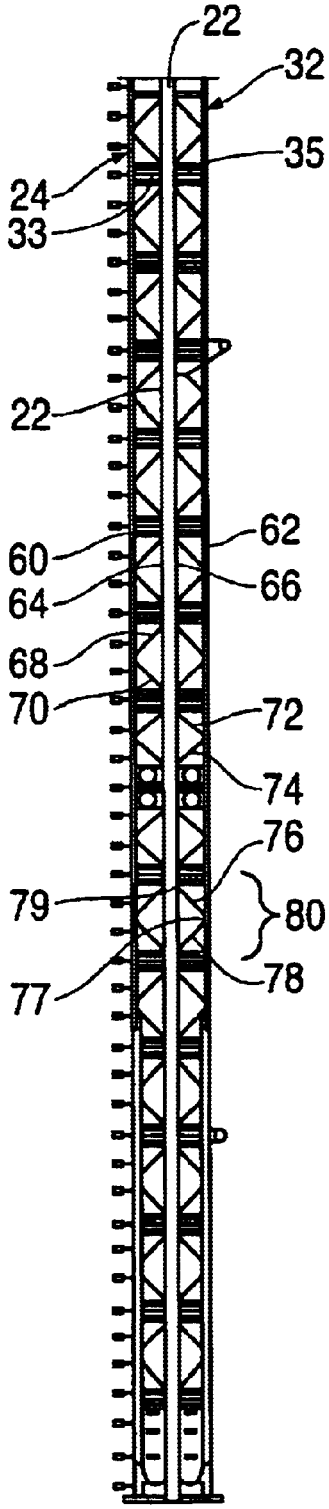
FIG. 3 illustrates a cross-section of the mast of FIG. 2 taken along line A—A.

Reference is now made to FIG. 3 that illustrates a cross-section of the mast 10 of FIG. 2 taken along the A—A line. The construction of a fin 24, 32 includes a plurality of bars 68–78 that extend between a first side 60, 62 and a second side 64, 66 of each fin 24, 32.

In the same or another exemplary embodiment of the present invention, each bar 68–78 extends diagonally from one side 60, 62 of a fin 24, 32 to the other side 64, 66 of the fin 24, 32, and in a direction that is opposite to an adjacent bar.

In the same or another exemplary embodiment of the present invention, the mast 10 is divided into sections, such as section 80, and each section 80 includes at least two bars 76, 78 that extend diagonally across, for example, fin 32, and in a direction opposite to an adjacent one of the bars 76, 78. It should be understood by one of ordinary skill in the art that a fin 24, 32, may be divided into any number of M sections, where M may be any number, including one.

In an exemplary embodiment of the present invention, support members 33, 35 are positioned in each section 80, along side each fin 24, 32 to provide torsional support.

In an exemplary embodiment of the present invention, each bar extends diagonally from approximately a mid-point of one of the sides of each section 80 to a corner of the opposite side, and in a direction opposite to an adjacent bar. For example, with respect to fin 32, bar 76 extends from approximate mid-point 77 of side 62 to corner 79 of side 66. In an exemplary embodiment of the present invention, the bars 68–78 are coupled to each fin 24, 32, for example, by welding the bars 68–78 to each fin 24, 32. It should be understood by one of ordinary skill in the art that the number of bars per fin 24, 32 may vary, and may there may even be just one bar per fin.

In an exemplary embodiment of the present invention, each fin is made form a metal plate. However, by constructing each fin from a plurality of bars, as shown in FIG. 2, less raw material is utilized, and the structural integrity of the mast is maintained. Moreover, the weight of the mast is reduced and the mast is easier to assemble, test, and install on an antenna tower.

Another advantage of the lighter weight design of mast 10, in accordance with the present invention, is that less labor and time is required to fabricate and galvanize the mast 10 because the mast 10 is easier to handle.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An antenna mast, comprising:

N faces, where N is an integer;

N corners, wherein each of said N corners is intermediate adjacent ones of said N faces; and N fins, wherein said N fins comprising M sections, where M is an integer, extend radially from each of said N corners, wherein each of said N fins comprises a plurality of bars, and wherein at least two of the plurality of bars are spaced apart in each of the M sections.

2. The antenna mast of claim 1, further comprising an inner support structure, wherein each of said N fins extends radially from said inner support structure.

3. The antenna mast of claim 2, wherein each of said N fins extends between said inner support structure and one of said N corners.

4. The antenna mast of claim 2, wherein the inner support structure is hollow.

5. The antenna mast of claim 2, wherein each of said N fins are welded to the inner support structure.

6. The antenna mast of claim 2, wherein the inner support structure is cylindrical in shape.

7. The antenna mast of claim 6, wherein a diameter of said inner support structure is approximately six inches.

8. The antenna mast of claim 2, wherein the inner support structure has a wall thickness of approximately four tenths of an inch.

9. The antenna mast of claim 1, wherein said plurality of bars extends between a first side of each of said N fins and a second side of each of said N fins.

10. The antenna mast of claim 1, wherein each of said plurality of bars extends diagonally across each of said N fins in a direction opposite to an adjacent one of said plurality of bars.

11. The antenna mast of claim 1, wherein said at least two of the plurality of bars extend diagonally across each of said M sections in opposite directions.

12. The antenna mast of claim 1, wherein N is five.

13. The antenna mast of claim 1, wherein each of said N faces has a radially extending flange.

14. The antenna mast of claim 13, wherein each radially extending flange is coupled to an adjacent flange.

15. The antenna mast of claim 1, further comprising a base, wherein each of said N faces is coupled to said base.

16. The antenna mast of claim 1, further comprising a base, wherein each of said N fins is coupled to said base.

17. The antenna mast of claim 1, wherein each of said N fins has a first side and a second side, and wherein each of said plurality of bars extends diagonally from approximately a mid-point of the first side of each of said M sections to a corner of the second side of each of said M sections, and in a direction opposite to an adjacent one of said plurality of bars.

18. An antenna mast, comprising:

means for coupling N faces of the antenna mast together, where N is an integer;

means for sectioning said antenna mast, wherein each of said sectioning means has a first side and a second side, and wherein said sectioning means is positioned intermediate adjacent ones of said N faces; and means for coupling a plurality of bars between the first side and the second side of said sectioning means.

19. A method of manufacturing an antenna mast, comprising:

coupling N faces of the antenna mast together, where N is an integer;

positioning a fin, having a first side and a second side, intermediate adjacent ones of said N faces;

forming the fin by extending a plurality of bars between a first side and a second side of said fin; and coupling said plurality of bars to said fin.

20. The antenna mast of claim 19, further comprising:

extending each of said plurality of bars diagonally across said fin in a direction opposite to an adjacent one of said plurality of bars.

* * * * *